United States Patent [19]

Bauch et al.

[11] 4,153,212

[45] May 8, 1979

[54] APPARATUS FOR ACCUMULATING ROPES IN STORAGE CANS

[75] Inventors: Ernst Bauch, Bordesholm; Hans D. Kayser; Herbert Peters, both of Neümunster, all of Fed. Rep. of Germany

[73] Assignee: Neümunstersche Maschinen- und Apparatebau Gesellschaft mbH, Neümunster, Fed. Rep. of Germany

[21] Appl. No.: 882,567

[22] Filed: Mar. 2, 1978

[30] Foreign Application Priority Data

Mar. 3, 1977 [DE] Fed. Rep. of Germany ..... 2709252

[51] Int. Cl.[2] ..... B65H 54/76

[52] U.S. Cl. ..... 242/47; 19/159 R; 28/289; 242/82

[58] Field of Search ..... 242/47, 82, 83, 1; 57/34 R; 28/289; 19/159

[56] References Cited

U.S. PATENT DOCUMENTS

| | | | |
|---|---|---|---|
| 351,839 | 11/1886 | Lenox | 242/82 X |
| 373,463 | 11/1887 | Lenox | 242/83 X |
| 2,971,243 | 2/1961 | Burns | 242/1 X |
| 2,971,683 | 2/1961 | Paulsen | 242/82 X |
| 3,204,940 | 9/1965 | Morgan | 242/82 X |
| 3,405,885 | 10/1968 | Schroder et al. | 242/83 |
| 3,469,798 | 9/1969 | Schroder | 242/83 |
| 3,644,968 | 2/1972 | Elliott et al. | 28/289 X |
| 3,667,092 | 6/1972 | Engels | 242/47 |
| 3,964,691 | 6/1976 | Pearce et al. | 242/47 |
| 4,069,566 | 1/1978 | Sumitomo et al. | 28/289 |

FOREIGN PATENT DOCUMENTS

| | | | |
|---|---|---|---|
| 913474 | 12/1963 | United Kingdom | 242/82 |

*Primary Examiner*—Stanley N. Gilreath
*Attorney, Agent, or Firm*—Michael J. Striker

[57] ABSTRACT

An apparatus is disclosed by which ropes and similar elongated objects can be accumulated in storage cans. The object is advanced through an upright stationary upstream guide tube and through a rotating downstream guide tube and its discharging end distant from the axis of rotation. A braking drum coaxially surrounds the orbiting trajectory of the discharging end of the downstream guide tube so that the portions of the objects which are being discharged through the discharging end impinge against the inner surface of the braking drum. The inner surface of the braking drum is arched, such as partly circular or partly parabolical in axial section and the objects rebound therefrom at an angle corresponding to the angle of incidence of the object on the inner surface. The downstream guide tube has a cross section exceeding that of the upstream guide tube. A ceramic annular element is arranged at the lower end of the upstream guide tube. The downstream guide tube is welded in a rotary body and the discharging end thereof is flush with the outer periphery of the rotary body. The upstream guide tube is accommodated in a hollow shaft of the motor which directly drives the rotary body.

14 Claims, 1 Drawing Figure

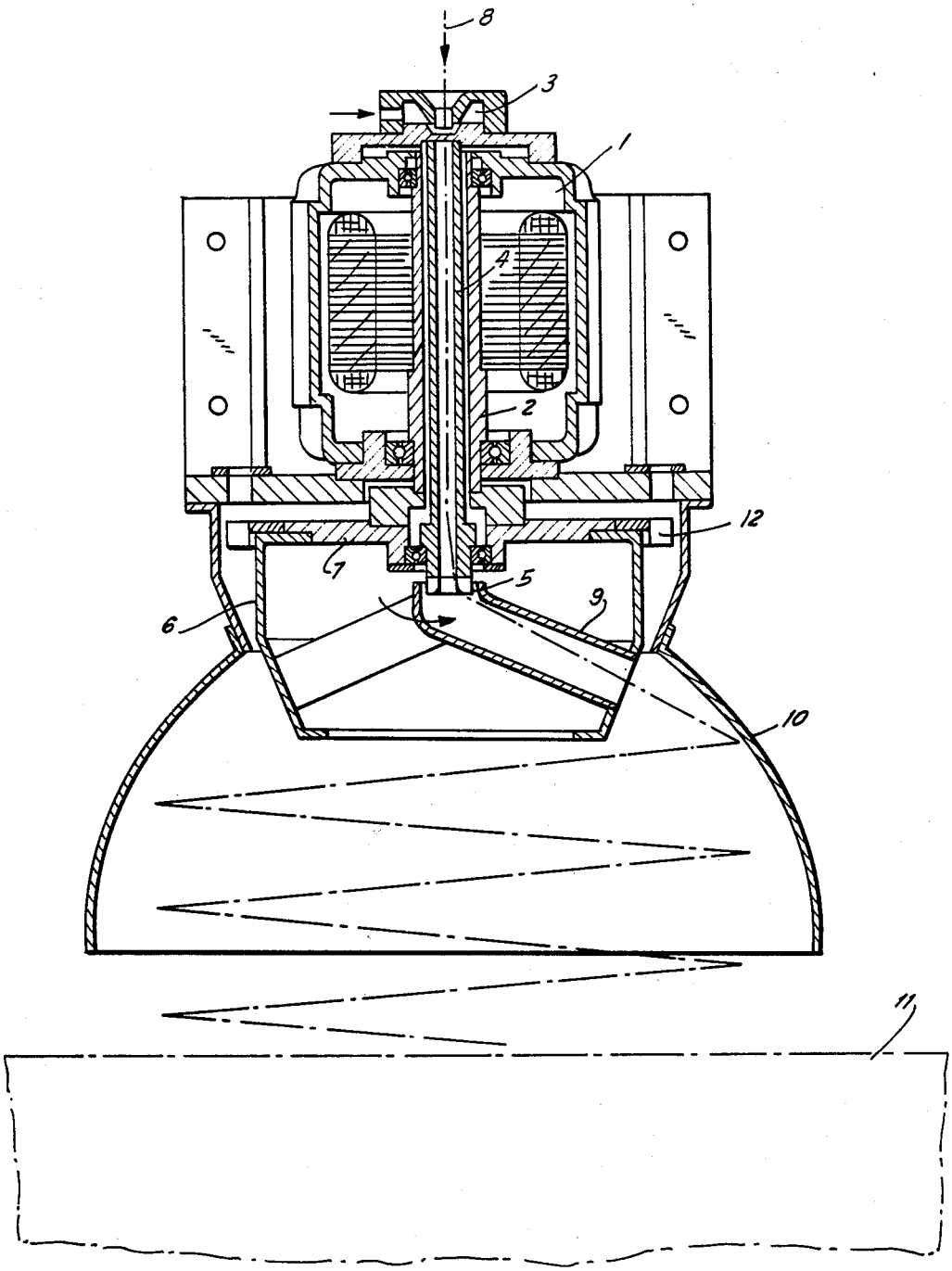
8
3
1
4
2
12
7
5
9
6
10
11

APPARATUS FOR ACCUMULATING ROPES IN STORAGE CANS

BACKGROUND OF THE INVENTION

The present invention relates to an apparatus for accumulating elongated flexible objects, such as ropes, in storage cans. More particularly, the present invention is concerned with such an apparatus which is especially suited for use in connection with reciprocating quadratic or rectangular cans, or rotating cylindrical cans, for laying the elongated object thereinto.

There are already known various apparatuses for introducing flexible objects, such as ropes, into storage cans for the flexible objects to be stored therein. These apparatuses find a very prominent, but not exclusive, use immediately downstream of a machine which produces the elongated object, such as a twisting or interwining machine in the event that the object is a rope. While the present invention will be hereafter described and discussed as used in connection with ropes or cables, it is to be understood that the basic concept of the present invention can also be used in connection with other elongated flexible objects. Thus, when the flexible object is a rope, it is already known to arrange the storage can in which the rope is to be accumulated as immediately downstream of the rope-spinning machine as practicable. Usually, upon emerging from the rope-spinning machine, the just-produced rope is trained around a plurality of pulleys, rollers or the like, and then it is introduced in between two driven cylinders which forward the rope into a can which is positioned underneath the driven cylinders. The circumferential surfaces of the cylinders can be either smooth or corrugated. When the outer surface of at least one of the driven surfaces is corrugated, the tendency of the rope to form entanglements either in the can or on its way into the can is suppressed.

However, experience with this conventional type of apparatus for accumulating ropes in storge cans has shown that many difficulties are encountered in such apparatus, primarily as a result of the relatively high speeds at which the apparatus operates in view of the relatively high speeds at which modern rope-spinning machines produce the rope which then issues and is forwarded by the driven cylinders at such a high speed toward the apparatus for accumulating the rope in a storage can. It will be appreciated that the forwarding speed of the driven cylinders will have to correspond to the issuing speed of the rope from the rope-spinning machine, so that the full utilization of the capacity of the spinning machine calls for accumulating the rope in the storage can at such a high speed. The most important problem encountered in such an apparatus is that, at such high speeds, the accumulating rope forms convolutions and entanglements in the storage can so that it becomes very difficult to subsequently withdraw the accumulated rope from the storage can for further use. Another drawback also exists when the driven cylinders are corrugated, which results from the fact that the rotating driven cylinders generate strong air currents during their rotation, which air currents cause turbulent conditions in the respective storage can so that the contents of the latter, that is, the accumulating rope, is subjected to the action of such turbulent air conditions and air currents existing because of that, as a result of which the danger of formation of entanglements in the storage can become even more pronounced.

To reduce the likelihood of the formation of such entanglements, it has been already proposed to diminish the speed of movement of the rope or cable prior to its introduction into the storage can. So, for instance, the German published patent application DT-OS No. 23 31 114 discloses an apparatus which serves this purpose and which includes a hollow body which is arranged at an angle with respect to and against the direction of movement of the fibrous cable, the hollow body being supported for pivoting and being constructed as a body of rotation. The purpose of this apparatus is to achieve a virtually impact-free transition of the movement of the cable from a straight path to a helical path within the hollow body. A uniform retardation or braking of a cable takes place at the inner wall of the hollow body which is constructed as a rotationally symmetrical guide surface.

However, even this apparatus does not eliminate the above-mentioned problems, even though it makes them less likely to occur. This is attributable to the fact that the braking of the cable or rope to a zero speed does not occur in the hollow body but rather only in the can itself. Of course, the likelihood of the occurrence of those problems which have been previously mentioned is proportional to the remaining speed of movement of the cable longitudinally thereof; nevertheless, even under the best circumstances, the cable or rope will retain some of its speed in this arrangement so that the possibility of formation of entanglements exists even under most advantageous circumstances.

A quite successful attempt to eliminate the above-mentioned problems by reducing the speed of the longitudinal advancement of the cable to virtually zero has been disclosed in a commonly owned U.S. Patent application Ser. No. 745,674, wherein the cable or rope is being advanced longitudinally thereof through a guide tube which rotates about a vertical axis and has an upstream portion surrounding, and a downstream portion deviating from, the above-mentioned axis, the downstream portion having a discharging end which orbits the vertical axis. A braking drum of a substantially cylindrical or of a slightly downwardly conically diverging configuration surrounds the orbiting trajectory of the discharging end so that the cable emerging from the latter impinges the inner surface of the braking drum and is reduced in speed to substantially zero upon such an impingement.

As advantageous as the solution may be in all other respects, experience therewith has shown that it still leaves something to be desired in other respects. Thus, it has been discovered that, after an extended period of use of this apparatus, the interior of the guide tube may become soiled by deposits carried by the cable, such as preparation, avivage, water or similar deposits. It will be appreciated that, if a depositing layer of these and other substances were allowed to develop, the operation of the apparatus and especially the speed of advancement of the cable or rope therethrough would be considerably impaired, especially when the developing layer is sticky. Thus, this apparatus is capable of operating at optimum parameters only if it undergoes frequent cleaning operations.

The problem of formation of the depositing layer is most pronounced in the rotating upright part of the guide tube, particularly as a result of the fact that the centrifugal forces acting in this rotating upright portion will force the above-mentioned substances in the radially outward direction where they will become firmly attached.

Then, it is possible to dislodge these deposits only by resorting to rather cumbersome cleaning operations. The performance of the cleaning operations, of course, calls for an interruption of the operation of the apparatus and, hence, also of the rope-spinning machine, which substantially detracts from the optimum utilization of these devices.

Another drawback of this apparatus is that the guide tube which is rigid with a rotary body is driven from a motor by a belt drive, the motor as well as the belt drive being arranged upwardly of the braking drum. This type of a drive, which is to be operated at the required high advancement speeds of the ropes amounting to 3,000 to 6,000 meters per minute, has the disadvantage that it may be initially or may become dynamically imbalanced, the latter by deposition of fiber ends and slubs at the various components of the drive. It will be appreciated that the dynamic imbalance will result in an increased wear of the various components of the drive.

Furthermore, it has been established that the cylindrical or even the conical configuration of the inner surface of the braking drum does not present an optimum solution. Whatever the reasons therefor, it has been found that the turns of the cable which fall into the storage can sometimes overlap each other on their way into the storage can. As a result of this, there are obtained convolutions and entanglements which then create problems when the cable or rope is to be withdrawn from the storage can.

SUMMARY OF THE INVENTION

Accordingly, it is a general object of the present invention to avoid the above-mentioned disadvantages.

More particularly, it is an object of the present invention to provide an apparatus for accumulating ropes and similar elongated flexible objects in storage cans which is not possessed of these disadvantages. Yet another object of the present invention is to so construct the apparatus that the rope turns will not overlap on their way into the storage can.

A concomitant object of the present invention is to provide an apparatus of this type which is simple in construction, reliable in operation, and inexpensive to manufacture and operate.

A still further object of the present invention is to so design the apparatus that the above-mentioned possibility of formation of deposits in the guiding tube is largely eliminated.

Finally, it is an object of the present invention to so construct a drive for the guiding tube as to be much less prone to develop a dynamic imbalance than heretofore known.

In pursuance of these objects and others which will become apparent hereafter, one feature of the present invention resides, briefly stated, in an apparatus for accumulating ropes and similar elongated flexible objects in storage cans, which comprises means for confining a respective object for a longitudinal advancement, including a stationary upstream guide tube having an upright axis and a rotatable downstream guide tube having an inlet end coaxial with the upstream guide tube and a discharging end at a distance from the upright axis; means for advancing the object through the guide tubes; means for rotating the downstream guide tube about the upright axis; and a stationary braking drum coaxial with the upstream guide tube and having an internal contact surface with which the object comes into contact upon discharge out of the discharging end of the downstream guide tube. Preferably, the downstream guide tube encloses an acute angle with the upright axis.

According to a further advantageous aspect of the present invention, the confining means further includes a wear-resistant annular element which is rigidly connected to the upstream guide tube at the lower end thereof which communicates with the inlet end of the downstream guide tube. Advantageously, the annular element is of a ceramic material and its inner confining surface registers with a substantially cylindrical inner surface of the upstream guide tube.

According to a further concept of the present invention, the rotating means includes a rotary body, and the downstream guide tube is rigidly connected to the rotary body for joint rotation therewith about the upright axis, preferably weldingly connected. Then, it is advantageous for the discharging end of the downstream guide tube to be flush with the outer periphery of the rotary body. Advantageously, the rotating means further includes a motor which has an output shaft which is directly connected to the rotary body, the output shaft being preferably hollow and the upstream guide tube being accommodated in the hollow output shaft. It is further very advantageous when the respective inner surfaces of the upstream and downstream guide tubes are provided with a layer of friction-reducing substance.

The above-mentioned advancing means advantageously includes a pneumatic fluid injector which is arranged at the upper end of the upstream guide tube. Then, it is further advantageous when the downstream guide tube has a flow-through cross-sectional area exceeding that of the upstream guide tube. It is further advantageous when the merger region at which the guide tubes communicate with each other is configurated as an overlapping.

It is further advantageous in the context of the present invention when the internal contact surface of the braking drum has an arcuate configuration, such as being partly circular or partly parabolical in axial section. Advantageously, the internal contact surface of the braking drum is so configurated that the angle of incidence of the object thereon corresponds to the angle of rebound of the object therefrom.

As a result of the construction of the apparatus for accumulating ropes and similar flexible objects in storage cans in accordance with the present invention, no centrifugal forces are active in the upright upstream guide tube any longer so that the possibility of the formation of deposits in the interior of such an upstream guide tube is, by and large, eliminated. On the other hand, no deposits will develop in the rotating downstream guide tube at all or, if they begin to develop, the substances will be centrifugally moved and eventually ejected from the downstream guide tube before they get a chance of forming any deposit layer to speak of. However, because of the relatively large flow-through cross-sectional area of the downstream guide tube, it is quite easy to manually clean the interior of the downstream guide tube, if and when necessary. On the other hand, the arched configuration of the internal contact surface of the brake drum, in cooperation with the selected angle of impingement, result in the formation of a precise turn of the rope without incurring the danger of overlapping of the individual turns of the rope.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

BRIEF DESCRIPTION OF THE DRAWING

The sole FIGURE of the drawing is an axially sectioned side elevational view of the apparatus for accumulating ropes in storage cans in accordance with the present invention.

DETAILED DISCUSSION OF THE PREFERRED EMBODIMENT

Referring now to the drawing in detail, it may be seen that the reference numeral 8 has been used to designate a cable or rope which may be issuing from a cable-spinning machine or the like. The rope 8 is conveyed toward the apparatus of the present invention for accumulating ropes in storage cans in a well-known conventional manner, such as being trained about a plurality of discs or pulleys and proceeding toward and between a pair of advancing rollers or cylinders which forward the rope 8 toward the apparatus of the present invention which lays the rope 8 into a diagrammatically illustrated storage can 11. The storage can 11 may be cylindrical and rotate about its vertical axis or it may be square or rectangular in horizontal section and may be reciprocated in one or two directions along a horizontal plane. The rotation or reciprocation of the storage can 11 serves the purpose of obtaining homogeneous distribution of the rope 8 in the interior of the storage can 11.

The apparatus of the present invention includes a rotary body 6 which is driven in rotation by a motor 1 which is connected to an intermediate flange 7. The motor 1 has a hollow output shaft 2 which is driven into rotation by the motor 1.

An upright stream guide tube 4 is accommodated in the interior of the hollow output shaft 2 so as to be stationary. This upstream guide tube 4 reaches with its lower end into an arcuate downstream guide tube 9 which is rigidly connected to the rotary body 6, for instance, by welding. The arcuate downstream guide tube 9 has a flow-through cross-sectional area exceeding that of the upstream guide tube 4. A pneumatic fluid injector 3 is arranged about the path of movement of the rope 8 at the upper end of the upright upstream guide tube 4. A ceramic annular element 5 is rigidly connected to the upstream guide tube 4 at the lower end thereof and has an internal confining surface which steplessly registers with the inner surface of the upstream guide tube 4. As a result of being subjected to centrifugal forces, the cable or rope 8 runs around the confining surface of the ceramic annular element 5 and thus removes any deposits which may have developed on, or even prevents the formation of such deposits on, the internal confining surface of the ceramic annular element 5.

A braking drum 10 surrounds the orbiting trajectory of the discharge end of the downstream guide tube 9 and has an internal contact surface with which the increments of the rope 8 which issue from the discharge end of the downstream guide tube 9 come into contact upon discharge. It is also illustrated that the braking drum 10 has an arcuate configuration, being, for instance, partly circular or partly parabolical in axial section. Thus, the angle of impaction or incidence of the increments of the rope onto the internal surface of the braking drum 10 corresponds to the angle of rebound of these increments from the internal surface of the braking drum 10.

It can also be ascertained from the drawing that the discharging end of the downstream guide tube 9 is flush with the outer periphery of the rotary body 6. This, as well as the expedient of providing the intermediate flange 7 with blower blades 12, facilitates the progression of the discharged rope 8 downwardly into the storage can 11. Namely, the blades 12 generate a downwardly oriented stream of air which presses the rope 8 downwardly through the space bounded by the smooth outer periphery of the rotary body 6 and the internal surface of the braking drum 10, which airstream enhances the descent of the turns of the cable or rope 8 from the very beginning of the operation of the arrangement of the present invention.

Having so discussed the construction of the arrangement of the present invention, the operation thereof will now be briefly discussed. First, during the initial running-in period of operation, the rope 8 is entrained by the pressurized fluid issuing from the pressurized fluid injector 3 and is carried thereby through the interior of the guide tubes 4 and 9 toward and out of the discharging end of the guide tube 9, upon which the discharged portions of the rope 8 come into contact with the internal contact surface of the braking drum 10. On the other hand, during the steady-state operation of the arrangement, centrifugal forces acting on the discharged portions of the rope 8 may be high enough to press the discharged portions of the rope 8 against the internal surface of the braking drum 10. When the discharged portions of the rope 8 contact the internal surface of the braking drum 8, their advancement is retarded to virtually zero, particularly when the guide tube 9 rotates at a speed of angular displacement at which the discharge end of the guide tube 9 orbits about the axis at a circumferential speed which is the same as the speed at which the rope 8 is discharged from the discharge end of the guide tube 9. Upon impinging on the internal contact surface of the braking drum 10, the respective portion or increment of the rope 8 rebounds from the internal surface and then descends into the storage can 11 due to the influence of gravity so that a rope helix is formed at the braking drum 10 as diagrammatically indicated in the drawing. The speed at which the rope 8 is discharged from the discharge end of the guide tube 9 equals the speed at which the rope 8 enters the upper end of the guide tube 4 which, in turn, is equal to the speed at which the rope is being spun by the rope-spinning machine. However, upon contacting the internal surface of the braking drum 10, the longitudinal speed of the rope 8 is reduced to zero or substantially zero, and from now on the rope 1 will only descend, in a form of the above-mentioned helix, into the storage can 11. The gravitational descent of the turns of the helix will further be enhanced and expedited by the stream of air which is created, in the above-mentioned manner, by the blower blades 12 provided on the intermediate flange 7. When the turns of the rope 8 reach the storage can, they will become accumulated therein without forming any entanglements or the like.

Inasmuch as the rotary body 6 is directly driven by the motor 1, without the interposition of any transmission therebetween, the likelihood of the formation of any dynamic imbalance is considerably reduced as compared to the prior-art arrangements.

It will be understood that each of the elements described above, or two or more together, may also find a useful application in other types of constructions differing from the types described above.

While the invention has been illustrated and described as embodied in an apparatus for accumulating ropes and similar elongated flexible objects in storage cans for use immediately downstream of a rope-spinning machine, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

1. An apparatus for accumulating ropes and similar elongated flexible objects in storage cans, comprising means for confining a respective object for a longitudinal advancement, including a stationary upstream guide tube having an upright axis and a rotatable downstream guide tube having an inlet end coaxial with said upstream guide tube and a discharging end at a distance from said upright axis, wherein said downstream guide tube has a flow-through cross-sectional area exceeding that of said upstream guide tube, and wherein said guide tubes communicate with each other at a merger region, said merger region configurated as an overlap; means for advancing the object through said guide tubes; means for rotating said downstream guide tube about said upright axis; and a stationary braking drum coaxial with said upstream guide tube and having an internal contact surface of arcuate configuration and with which the object comes into contact upon discharge out of said discharging end of said downstream guide tube.

2. An apparatus as defined in claim 1, wherein said downstream guide tube encloses an acute angle with said upright axis.

3. An apparatus as defined in claim 1, wherein said guide tubes have respective inner surfaces; and further comprising a layer of friction-reducing substance at least on one of said inner surfaces.

4. An apparatus as defined in claim 1, wherein said upstream guide tube has an upper end; and wherein said advancing means includes a pneumatic fluid injector arranged at said upper end of said upstream guide tube.

5. An apparatus as defined in claim 1, wherein said arcuate configuration is partly circular in axial section.

6. An apparatus as defined in claim 1, wherein said arcuate configuration is partly parabolical in axial section.

7. An apparatus as defined in claim 1, wherein said internal contact surface of said braking drum is so configurated that the angle of incidence of the object thereon corresponds to the angle of rebound of the object therefrom.

8. An apparatus for accumulating ropes and similar elongated flexible objects in storage cans, comprising means for confining a respective object for a longitudinal advancement, including a stationary upstream guide tube having an upright axis and a rotatable downstream guide tube having a discharging end at a distance from said upright axis; means for advancing the object through said guide tubes; means for rotating said downstream guide tube about said upright axis, said rotating means including a rotary body and a motor having a hollow output shaft directly connected to said rotary body, and wherein said upstream tube is accommodated in said hollow output shaft and said downstream guide tube is rigidly connected to said rotary body for joint rotation therewith about said upright axis; and a stationary braking drum coaxial with said upstream guide tube and having an internal contact surface with which the object comes into contact upon discharge out of said dicharging end of said downstream guide tube.

9. An apparatus as defined in claim 8, wherein said confining means further includes a wear-resistant annular element rigidly connected to said upstream guide tube at said lower end thereof.

10. An apparatus as defined in claim 9, wherein said annular element is of a ceramic material.

11. An apparatus as defined in claim 9, wherein said upstream guide tube has a substantially cylindrical inner surface and said annular element has a confining surface registering with said inner surface.

12. An apparatus as defined in claim 9, wherein said rotating means includes a rotary body; and wherein said downstream guide tube is rigidly connected to said rotary body for joint rotation therewith about said upright axis.

13. An apparatus as defined in claim 12, wherein said rotary body has an outer periphery; and wherein said discharging end of said downstream guide tube is flush with said outer periphery of said rotary body.

14. An apparatus as defined in claim 12, wherein said downstream guide tube is weldingly connected to said rotary body.

* * * * *